US006869078B1

(12) United States Patent
Slowinski

(10) Patent No.: US 6,869,078 B1
(45) Date of Patent: Mar. 22, 2005

(54) SYSTEM AND METHOD FOR MAINTAINING AUDIENCE INTEREST IN PRODUCTIONS, INCLUDING ANONYMOUS AUTO RACE

(76) Inventor: Don Slowinski, 1700 Rockville Pike #400, Rockville, MD (US) 20852

( * ) Notice: Subject to any disclaimer, the term of this patent is extended or adjusted under 35 U.S.C. 154(b) by 394 days.

(21) Appl. No.: 09/715,066

(22) Filed: Nov. 20, 2000

Related U.S. Application Data

(60) Provisional application No. 60/166,165, filed on Nov. 18, 1999.

(51) Int. Cl.[7] ..... A63F 7/14
(52) U.S. Cl. ..... 273/445; 273/459; 463/6
(58) Field of Search ..... 273/459, 445, 273/138.1; 463/6, 16, 40

(56) References Cited

U.S. PATENT DOCUMENTS

| | | | | |
|---|---|---|---|---|
| 3,734,500 A | | 5/1973 | Cooper | |
| 5,186,460 A | * | 2/1993 | Fongeallaz et al. | 463/6 |
| 5,398,941 A | * | 3/1995 | Paulson | 273/445 |
| 5,444,628 A | * | 8/1995 | Meaney et al. | 701/109 |
| 5,652,964 A | * | 8/1997 | Reinheardt | 2/424 |
| 5,702,107 A | | 12/1997 | Novak | |
| 6,293,548 B1 | * | 9/2001 | Swyers et al. | 273/236 |

OTHER PUBLICATIONS

Dehne, Sam. Will FAA Okay Night–Time Drag Racing on Reno Airport's Main Runway? PRWeb: The Free Wire Service. Jan. 25, 1998 [online], [retrieved on Dec. 24, 2002]. Retreived from the Internet <URL: http://www.prweb.com/releases/1998/1/prweb3300.php>.*

Myers, Mike. In myTSN.com [online]. Dec. 26, 2001 [retreived on Dec. 24, 2002]. Retrieved from the Internet <URL: http://www.mytsn.com/publ/publ.asp?pid=4413>.*

IROC Racing Series. Introduction, Series Rules [online]. [retrieved on Dec. 24, 2002]. Retrieved from the Internet <URL: http://irocracing.com/current_season/series.html>.*

"Brannen Continues to Dominate Thursday Thunder". Atlanta Motor Speedway. Aug. 5, 1999. [retrieved on Dec. 24, 2002]. Retrieved from the Internet <URL: http://www.atlantamotorspeedway.com/newsarchive/1999/08/aug5.shtml>.*

Charlotte Observer, Observer News Services, "Miller's got to have his space" Jul. 11, 1995.

IDDA 2002 Demolition Derby Rules & Regulations Car Prep Rules and Basic Regulations. website:derby.com.

Pearl, Daniel, "Demolition Derby, A lawless Sport, Gets Some Rules", The Wall Street Journal, Oct. 4, 1994.

* cited by examiner

*Primary Examiner*—Raleigh W. Chiu
(74) *Attorney, Agent, or Firm*—Michael D. Bednarek; Shaw Pittman LLP

(57) ABSTRACT

A system and method for maintaining audience interest in productions is disclosed. The invention includes provisions by which the interest of the audience is retained throughout the entire event. In one aspect, the invention includes a sporting event with anonymous contestants. In another aspect, the invention includes a limited performance-enhancing feature. The invention also includes provisions to expand audience participation and interaction. The invention also includes prizes that are awarded to the audience, based on several factors, including association with contestants.

10 Claims, 1 Drawing Sheet

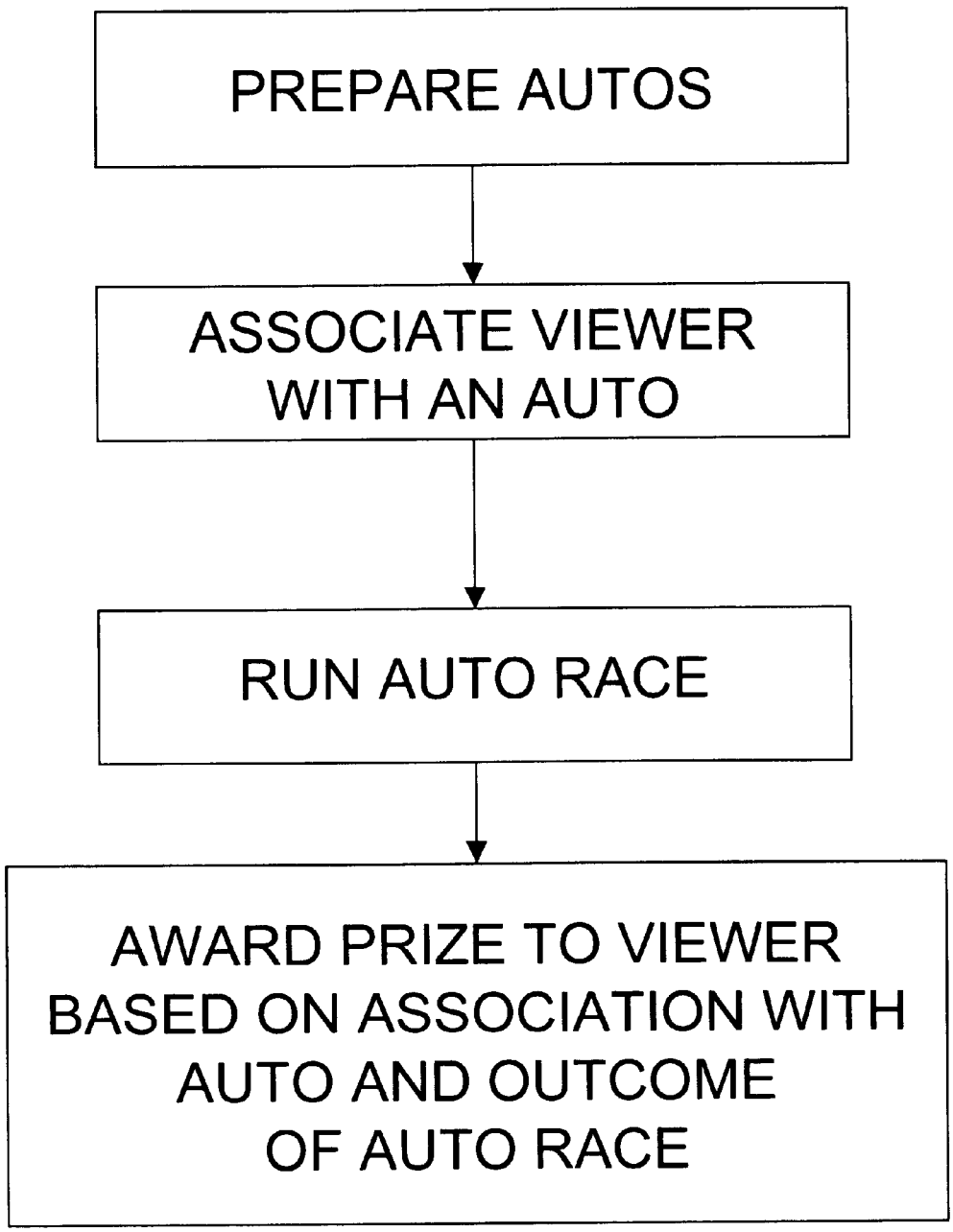
PREPARE AUTOS
ASSOCIATE VIEWER WITH AN AUTO
RUN AUTO RACE
AWARD PRIZE TO VIEWER BASED ON ASSOCIATION WITH AUTO AND OUTCOME OF AUTO RACE

SYSTEM AND METHOD FOR MAINTAINING AUDIENCE INTEREST IN PRODUCTIONS, INCLUDING ANONYMOUS AUTO RACE

RELATED APPLICATIONS

This application claims priority to U.S. Provisional Application No. 60/166,165, filed on Nov. 18, 1999, which is hereby incorporated by reference.

BACKGROUND

1. Field of the Invention

The present invention relates to system and method for maintaining live and remote audience interest in productions, including a method of conducting an auto race.

2. Background of the Invention

Currently, there are a wide variety of productions conducted in the hope of attracting fans. Fans may watch in person (i.e., by attending the live performances) or remotely (i.e., through broadcast or Webcast). During such events, it is typically in the sponsor's interest to keep fans interested in the event. In practice, however, there are many reasons why a fan's interest might wane during the event.

The term "auto" means any car, truck, boat, motorcycle, or any other vehicle that is self-propelled. An "auto race" is any event where at least one auto is involved in a speed contest.

In the field of auto racing, events such as NASCAR races are attended by race fans. Race fans are generally very loyal to their favorite race car driver. During a race, if their favorite driver is involved in an accident, experiences mechanical problems, falls far off the pace, or for some other reason it becomes clear that their favorite driver will not win, those fans loyal to the unfortunate driver who is not likely to win begin leaving the race before its conclusion.

The fan attrition is much worse in auto racing than in other professional sports. At least in other professional sports, like football or baseball, ideally half of the stands are filled with fans rooting for the winning team. Obviously, this percentage is much higher if the winning team is playing on its own home field and much lower if the winning team is playing an away game. Fans will also stay to watch a close game. So, in other professional sports there is a chance that most of the fans will stay until the end of the game.

In auto racing, however, very few fans stay for the entire race. A large number of cars, generally around forty cars, start the race. Not every driver has a loyal fan base; perhaps ten to twenty drivers out of forty will have loyal fans (as opposed to just two sets of loyal fans for most other professional sports). So, near the end of the race, there might be at most five cars in the lead pack. All of the remaining cars have either experienced accidents, mechanical breakdowns or are too far behind to catch the leaders. The fans rooting for those thirty five cars now out of contention most likely leave the race early. This leaves a very small percentage of fans, generally less than 20%, who stay for the entire race. Fans who might stay for a close race often do not get the opportunity. Races are rarely close and are generally decided by large margins.

In addition to the large percentage of fans that actually attend the race who lose interest before the finish, a large percentage of another group of fans, those watching the race on television, also tend to lose interest before the finish. The behavior of this second group of fans, the ones who watch the race on television, is very important to the success of any racing event. Disinterest by viewers in the later portions of the race tends to reduce the television ratings of event and thus diminishes the commercial value of the event. Maintaining high television ratings throughout the entire event, and not just the beginning, is critical to attracting and sustaining the support of sponsors.

Clearly, one of the shortcomings of conventional races and racing series is their lack of ability to retain the interest of a significant percentage of fans and viewers throughout the entire event. This problem is notable in the auto racing context, but is experienced to lesser or greater extents in almost all performance events.

SUMMARY AND OBJECTS OF THE INVENTION

The present invention provides a system and method for maintaining live and remote audience interest in performances. In a broad sense, the system and method operate by creating additional incentives including possible rewards to achieve the desired fan interest.

In one aspect of the present invention, the present invention provides a method for conducting a race where the identity of the race car drivers are unknown until the end of the race. The race cars are assigned a number, a symbol, a sponsor, a paint job or any other indicia which differentiates one car from another but does not identify the true identity of the driver.

In another aspect, the invention provides provisions to enhance interest; the cars may be equipped with performance-enhancing equipment that can be used only to a limited extent.

In another aspect, the invention provides fan participation in the race and the opportunity for fans to win prizes based on the outcome of the race.

In another aspect, the invention provides a related interactive event for fans at remote locations, such as fans watching a broadcast or Webcast of the event.

Additional features and advantages of the invention will be set forth in the description which follows, and in part will be apparent from the description, or may be learned by practice of the invention. The objectives and other advantages of the invention will be realized and attained by the method particularly pointed out in the written description and claims as well as the appended drawings.

It is to be understood that both the foregoing general description and the following detailed description are exemplary and explanatory and are intended to provide further explanation of the invention.

DETAILED DESCRIPTION OF THE PREFERRED EMBODIMENTS

In one embodiment of the present invention, the goal of the race is to conceal the identity of the drivers during the race and reveal the identity of the drivers after the race in order to provide excitement throughout the entire race and up to the conclusion of the race. The method of concealing the identities of the drivers can be accomplished many different ways. One preferred method is to have the drivers put on their helmets and enter their cars in closed garages, the interiors of which cannot be seen by the race fans. The drivers would then drive their cars out of the garage or garages onto the race track.

In the preferred embodiment of the present invention, the driver's cars are identically equipped so that no driver has an inherent advantage (other than different skill level) over other drivers. The cars may, as explained below, be equipped with performance-enhancing equipment that selectively provided a short burst of enhanced performance. The driver's ability to use this performance enhancer would be limited, e.g., six bursts per race, so that an element of strategy would be introduced: when to use the bursts.

The cars are preferably given a suitable indicia. The indicia preferably identifies the car for just one particular race only and does not provide any clues or associations into the identity of the driver. For example, of numbers were used, the numbers would be assigned in a way which would conceal the identity of the drivers and numbers which are associated with a particular driver would not be used for this race. Letters of the alphabet, colors, patterns, designs, symbols, sponsor's logos, words, proper nouns, and other suitable indicia could also be used, either alone or in combination with other types of indicia. Anything, as long as the indicia does not suggest the identity of the driver.

The race, in all other respects, would be run according to a preselected set of rules. Preferably, a pre-existing set of rules from an established governing body and racing series would be used, although the invention also contemplates modified rules for this race as well.

At the end of the race, all of the identities of all of the drivers would be revealed. Any suitable method for revealing their identities may be used to practice the present invention. Preferably, the identities of the drivers would be revealed in reverse finish order. In other words, the fans would learn the identities of the drivers from last place to first place. Preferably, the drivers would reveal their identities by "unmasking" themselves. They would "unmask" themselves by taking off their helmets.

Other embodiments of the invention include additional features to enhance fan excitement and interest. These features can be used alone, or in conjunction with other features.

Fans could pick or be assigned one of the cars and win prizes based on their association with the car.

If the fans are assigned a car, any suitable method could be used to assign a fan a particular car. One possible approach would be to associate a car with their seat number. For example, the last digit of a fan's seat number would be the car assigned to that fan for purposes of winning prizes. The ticket number could also be used. Numbers could also be assigned to fans when they enter the sports area by either randomly assigning numbers or basing the assignment on when they enter the arena.

If fans are allowed to pick their cars, any suitable selection method may be employed. The invention prefers the use of a form that is filled out with the fan's name, address, phone number, e-mail address and car selection which is scanned at the gate as the fan enters the arena. The form could be the back of the ticket or a separate form. Handwriting recognition could be used to simplify data entry into a computer system. The contact information on the form could be used to contact award winners. The contact information could also be used to generate mailing lists and other marketing databases.

In accordance with another aspect of the present invention, accurate demographic data may be captured from the fan's tickets using, for example, handwriting recognition software. Specifically, to enable the fans to compete for the million dollar prize in attendance, the fans will have to complete a special scannable ticket that will contain their particular demographic information including name, address, e-mail address, phone number and some other specific information, i.e., they verify that they are 18 years or older, depending on what information is desired. This is an immediate data base of information of fans that actually attended for the sponsors and the league and the motor sports operators to use. The tickets could be used to generate the slips or coupons that will be drawn for the prizes, so the scannable ticket is an important aspect of the embodiment of the present invention. The scannable ticket containing the information that is completed by the fan in advance can be used at many different entertainment venues and sporting events.

In another embodiment of the present invention, fans could select their cars from remote locations. In other words, both fans who actually attend the race, as well as those fans who watch the race from other locations, could pick cars, thus creating a fan to car or driver association. Fans could select cars from those remote locations in a variety of ways.

Fans could select cars over the Internet, either by directly communicating with an administrating organization or by logging onto a web site. Fans could send in their selections over the phone, and fans could pick cars by using an interactive television system. The interactive television system could be cable-based or include satellite broadcast technology.

Once fans have been associated with a race car by either selecting the car of their choice or by being assigned a car, prizes can be awarded. One way of awarding prizes is to award every fan associated with a car based on how well the car did in the race. For example, every fan who was associated with the winning car would win a certain prize, every fan associated with the second place car would win a prize of slightly less value than that awarded to the fans associated with the first place car, and so on. Prizes could be awarded to any number of fans. Conceivably, only the fans associated with the first place car would be awarded a prize, or fans associated with the first three finishers could be awarded prizes, or the first five finishers, or every race car. The specific number of winning cars whose fans are awarded prizes can be any desired number of cars.

In addition to having every fan associated with a car win a prize, the invention contemplates another way to award prizes. A significant prize could be awarded to one or a few fans, who are associated with a particular car, by random drawing. A sweepstakes could be held at the end of the race where all of the fans associated with the first place car are entered into a first drawing. A winner is selected at random and the winner of the first drawing is given a significant prize, for example, one million dollars, a new car, or another significant prize. Similarly, all of the fans associated with the second place finisher could also be entered into a second drawing and a random winner is also awarded a second significant prize, slightly inferior to the first significant prize. Additional drawings could be held for some or all of the rest of the remaining finishers with descending significant prizes awarded. Finally, there could also be an overall sweepstakes as well where every fan who attends could be entered.

There could be prizes awarded or no prizes awarded at a particular race or racing series. If prizes are awarded, the type, kind and number of prizes awarded could be the same for every race in a racing series or could vary from race to race in a racing series. Given a particular race, if prizes are awarded, prizes can be awarded to every fan who is associated with a particular car or a small number of significant prizes can be awarded for a select number of fans, or both types of prizes can be awarded.

The prizes can be awarded at the track at the end of the race or fans can claim their prizes later. If prizes can be claimed later, fans could mail in their ticket stubs or other verification documents to claim their prizes.

The FIGURE shows a series of steps, consistent with the present invention, in which several autos are prepared (preferably substantially identically), a viewer is associated with one of the autos, a race is run and at the end of the race, and based on its outcome, a prize is awarded to the viewer based on his association with the auto.

In accordance with another aspect of the present invention, each of the cars in the race can be equipped with a mechanism for increasing the performance of the vehicle for a limited period of time. Like other features, this feature can be used alone or in combination with other features. For example, this feature can be used in any auto race, including traditional types of auto races where the identity of the drivers is known. For example, the mechanism could be a boost button that is linked to nitrous oxide or other feed to the engine to increase the performance of the engine. Other provisions to increase the performance may also be used.

This would provide spectators with a much more exciting race. Generally, identically prepared cars that are presently raced, for example in the I.R.O.C. racing series, result in very infrequent passing. By using these specially-equipped race cars with their brief, limited performance-enhancing features, drivers are more likely to pass. The goal is to be able to give the drivers a limited number of performance boosts per race so that they can boost their car's performance for more frequent passing.

One example of this performance increasing mechanism would be a nitrous oxide tank. For example, the nitrous oxide tank could be used six times, for a ten-second boost of about 40–50 extra horsepower. The number of uses and the extent and duration of the boost can be varied by a technician. The important point is that each car is identically equipped and includes some mechanism for increasing performance of the car on demand of the driver, and that the mechanism has limited usage duration that is less than the duration of the entire race. That limited increase in the performance of a car forces the driver to use it so that there is an element of strategy introduced into the race that the driver has to select the most appropriate time to use his limited boost to the engine. For example, the driver can use it all at the beginning, spread it out throughout the race or wait, and save his whole tank for coming down the home stretch.

In accordance with another aspect of the present invention, fans may participate from a remote location through the global computer network or Internet. In particular, racing fans can communicate with a suitable website and participate in a Webcast. Fans can simply view the race and access additional information or fans can also compete against each other in contests or games hosted by the website. The contests can result in prizes for the fans.

In one example of an interactive contest, race fans at home would be given a list of the drivers for race event. They would not know specifically which of the cars the drivers are driving, and as the Webcast is broadcast the fans would have to determine which driver is driving which car. Preferably, hints may be given throughout the Webcast to assist the participants and to retain the participant's interest in the Webcast.

For example, audible hints could be provided. As a certain car is pictured, fans could monitor or listen to the communications between that car and the pit crew. Listening to the voice of the driver could assist fans in determining the driver's identity. In fact, true race fans would recognize the driver's voice and could immediately identify the driver and match the driver with the car.

An alternative method for providing hints to fans while still retaining their interest would be through the use of specific trivia questions. When a particular race car is shown on the Webcast, a trivia question associated with the unknown driver of that car could be displayed. The answer to the trivia question would either reveal the identity of the driver or would assist the fan in determining the driver.

Finally, fans could simply guess at which driver is driving which car. All of the fans who correctly guessed all or some of the drivers and were able to associate the drivers with their cars would qualify to be entered into a contest or random drawing. The winner of the contest or drawing could be awarded prizes, for example, a new car.

Fans could also participate from remote locations and participate in the contest from home or other locations. The contest also includes interactive capabilities that allow fans to click onto a particular car during the broadcast which would result in additional information being provided for that car. For example, a fan can click on a car, and the trivia question would be displayed. The contest could also provide alerts when drivers are talking in a particular car so a fan will be able to go through the field of cars and retrieve hints during the broadcast. Preferably, the Webcast will be simulcast with a network that broadcasts races.

Generally, the key feature of this aspect of the invention is that at the same time the event is broadcast, clues are provided, either visually, audibly or through the written trivia questions that help the user participate in this game but also require the user's constant attention to the broadcast. Attention is important because this would affect advertising interest in the broadcast as well.

In addition, although reference was made to Webcast, the broadcast can be in any form that allows interaction of the user from remote locations.

The present invention also provides another form of fan participation in a sporting event. In particular, an all-star or select player format sporting event, for example, football fans actively participate in the event itself. For example, in a football game, fans would be able to participate by calling the actual plays executed on the field.

In another embodiment of the present invention, fans would use a hand-held device to select the plays that are executed on the field and communicate their selections using the hand-held device.

In another embodiment of the present invention, which is preferably combined with other embodiments, fans would have a pre-approved credit line, or make some of deposit, and then bid against other fans in attendance. Fans would bid on plays and the fan with the highest bid would have his or her play run on the field. Additionally, other fans could participate over the Internet and both bid and select plays over the Internet. So, this embodiment permits global participation.

Additionally, play callers would be responsible for their play calls. All of the participants would be responsible for their play calls, so if a play is successful, the invention contemplates some type of reward from the sponsor on a point system, or if they are unsuccessful, they have points deducted or some other penalty would be assessed. Points would also be awarded for more exciting plays in addition to those that are more successful.

Although the principles of the invention could be applied to any sporting event or contest, football, and more particularly the Pro Bowl, is the preferred sporting event, because there is a limited playbook for a Pro Bowl.

The number of fan-selected plays could be limited and discretion could be given to a head coach to either run the fan-selected play or run another play.

In another embodiment of the present invention, the fans are able to actively participate by bidding a secondary format of the bidding process. Instead of just having the highest bidder call the play, and after the play is successful, the identity of the bidder is broadcast along with a message he wants to send out so that people can applaud him or boo him. This would increase fan excitement and interest.

In another embodiment of the present invention, the contest would include an aggregate count of the votes received for a given play, then that play with the most aggregate votes is called. But that would not recognize a specific individual, it would just show the percentage of how many votes were cast, how much total money was bid.

Other aspects and advantages of the present invention will be apparent to those skilled in the art from the detailed business plan description appended hereto as Appendix 1.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto and by their equivalents.

I claim:

1. A method of conducting an auto race comprising:

preparing a plurality of autos substantially identically;

keeping the identity of at least two drivers anonymous such that the respective identities are not disclosed to a viewing audience comprising viewers;

associating at least one viewer with an auto the step of associating comprising utilizing a computer; p1 running the auto race; and awarding at least one prize to the at least one viewer based on the at least one viewer's association with the auto and outcome of the auto race.

2. The method according to claim 1, wherein each of the autos includes at least one indicia that is different from all of the other autos entered into the race.

3. The method according to claim 1, wherein the identify of the drivers is revealed at the conclusion of the race.

4. The method according to claim 3, wherein the identity of the drivers is revealed in reverse finish order.

5. The method according to claim 1, wherein the prize is awarded at the conclusion of the race.

6. The method according to claim 1, wherein groups of viewers are entered into a random drawing that awards a significant prize.

7. The method according to claim 6, wherein the groups are established by the viewer's association with a driver.

8. The method according to claim 1, wherein at least one of the viewers is given an opportunity to guess the identify of at least one of the drivers.

9. The method according to claim 8, wherein a prize may be awarded if the viewer has correctly guessed the identify of the driver.

10. The method according to claim 1, wherein each of the autos includes a performance-enhancing feature that is actuated by the driver and has a limited duration.

* * * * *